US007846277B2

(12) United States Patent
Kehl et al.

(10) Patent No.: US 7,846,277 B2
(45) Date of Patent: Dec. 7, 2010

(54) PLANAR, ROLLED SEMI-FINISHED PRODUCT OF ALUMINUM ALLOYS

(75) Inventors: Werner Kehl, Jork (DE); Manfred Mrotzek, Buxtehude (DE)

(73) Assignee: Hydro Aluminium Deutschland GmbH, Koln (DE)

( * ) Notice: Subject to any disclaimer, the term of this patent is extended or adjusted under 35 U.S.C. 154(b) by 964 days.

(21) Appl. No.: 10/551,563

(22) PCT Filed: Mar. 31, 2004

(86) PCT No.: PCT/EP2004/003397

§ 371 (c)(1),
(2), (4) Date: Nov. 16, 2006

(87) PCT Pub. No.: WO2004/090184

PCT Pub. Date: Oct. 21, 2004

(65) Prior Publication Data

US 2007/0125465 A1 Jun. 7, 2007

(30) Foreign Application Priority Data

Apr. 8, 2003 (EP) ..... 03008147

(51) Int. Cl.
*C22F 1/047* (2006.01)

(52) U.S. Cl. ..... 148/696; 148/702

(58) Field of Classification Search ..... 148/440, 148/690–698, 702; 420/542
See application file for complete search history.

(56) References Cited

U.S. PATENT DOCUMENTS

| | | | | |
|---|---|---|---|---|
| 4,151,013 | A * | 4/1979 | Thompson et al. | 148/502 |
| 4,186,034 | A | 1/1980 | Akeret | |
| 5,480,498 | A | 1/1996 | Beaudoin et al. | |
| 5,993,573 | A | 11/1999 | Selepack et al. | |
| 6,383,314 | B1 * | 5/2002 | Dunbar et al. | 148/440 |
| 2007/0125465 | A1 | 6/2007 | Kehl | |

FOREIGN PATENT DOCUMENTS

| | | | |
|---|---|---|---|
| BE | EP 0507411 | * | 10/1992 |
| DE | EP 507411 | A | 7/1992 |
| EP | 1 466 992 | B1 | 4/2003 |
| JP | 4-301055 | | 10/1992 |
| JP | 4276050 | | 10/1992 |
| JP | 6-25787 | | 2/1994 |
| JP | 6-220564 | | 8/1994 |
| JP | 7-34208 | | 2/1995 |
| JP | 7-173585 | | 7/1995 |
| JP | 9-78169 | | 3/1997 |
| JP | 10-137860 | | 5/1998 |
| JP | 10-219412 | | 8/1998 |
| JP | 10-310854 | | 11/1998 |
| JP | 2006-522868 | | 10/2006 |
| KR | 10-716607 | | 5/2007 |

OTHER PUBLICATIONS

Introduction to Aluminum Alloys and Tempers, J. Gilbert Kaufman, ASM International, 2000.
International Search Report for PCT/EP2004/003397 (in English and German), Published Jun. 23, 2004.
J.R. Davis "Metals Handbook, Desk Edition" 1998, ASM International, Materials, p. 43.
JP 2006-504729 (published as JP 2006-522868) OA dated Jun. 8, 2009 (English Translation), pp. 1-4.
J. E. Hatch, Aluminum: Properties and Physical Metallurgy, ASM International 1984, pp. 128-131.
V. A. Phillips, et al. "Yield Point Phenomena and Stretcher-Strain 1482 Markings in Aluminum-Magnesium Alloys," Journal Institute of Metals, pp. 625-650.
M. Bloeck et al. "Aluminium-Karosseriebleche der Legierungsfamailie AlMg (Cu), Teil 1," Aluminum 71 1995, pp. 289-295.
David S. Thompson, "A Highly Formable Aluminum Alloy 5182-SSF." Society of Automotive Engineers, Inc. 1978, pp. 913-923.
"International Alloy Designations and Chemical Composition Limits for Wrought Aluminum and Wrought Aluminum Alloys," The Aluminum Association, Apr. 2006, pp. 1, 6.

* cited by examiner

*Primary Examiner*—George Wyszomierski
*Assistant Examiner*—Mark L Shevin
(74) *Attorney, Agent, or Firm*—Proskauer Rose LLP

(57) ABSTRACT

A flat, rolled semi-finished product made of an aluminum alloy and a method of producing the product are disclosed. The aluminum alloys has the following alloy proportions in weight percentages: $2 \leqq Mg \leqq 5$, $Mn \leqq 0.5$, $Cr \leqq 0.35$, $Si \leqq 0.4$, $Fe \leqq 0.4$, $Cu \leqq 0.3$, $Zn \leqq 0.3$, $Ti \leqq 0.15$, other elements totaling no more than 0.15 and separately not exceeding 0.05, and the remainder consists of Al. The semifinished product is rolled from a bar and, during the rolling process, is subjected to at least one intermediate tempering between two cold reduction passes and to a final soft-annealing in a chamber furnace. A semi-finished product of this type does not have any flow lines after shaping or deep-drawing if the degree of reshaping before the first intermediate tempering is equal to at least 50%, the degree of reshaping before the final soft-annealing is no greater than 30%, and the semifinished product is drawn by 0.1 to 0.5% after the final soft-annealing.

3 Claims, 1 Drawing Sheet

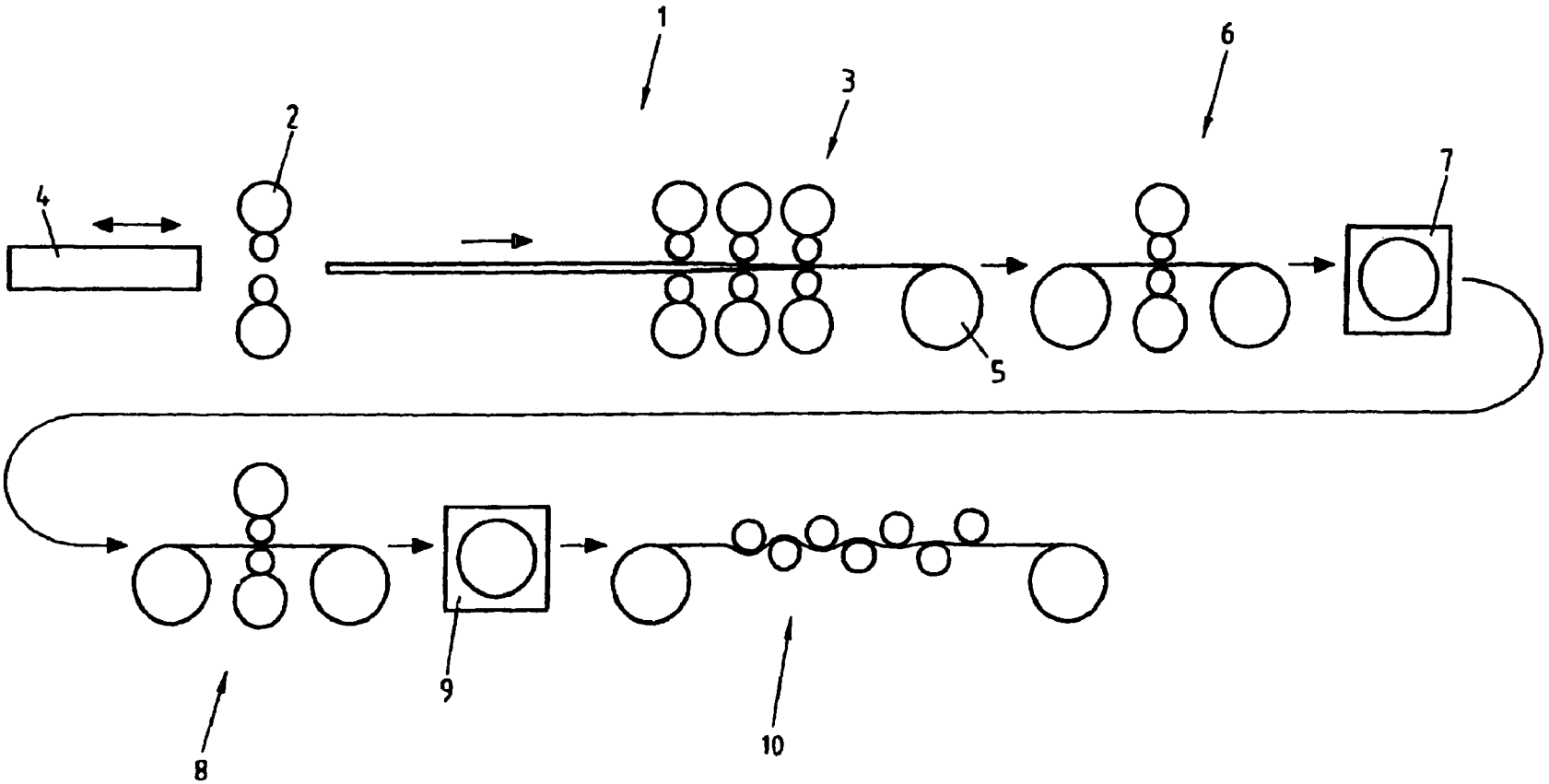
1
2
3
4
5
6
7
8
9
10

PLANAR, ROLLED SEMI-FINISHED PRODUCT OF ALUMINUM ALLOYS

CROSS-REFERENCE TO RELATED APPLICATIONS

This application is a National Phase Application of International Application No. PCT/EP2004/003397, filed on Mar. 31, 2004, which claims the benefit of and priority to European Patent Application No. 03 008 147.5 filed Apr. 8, 2003. The disclosures of the above applications are incorporated herein by reference in their entirety.

TECHNICAL FIELD OF THE INVENTION

The invention relates to a planar, rolled semi-finished product made of one or more aluminum alloys, such as aluminum strips or sheets for further processing by means of deforming or deep drawing (e.g., for the production of sheet metal for car bodies for the automobile industry), and methods of making such products. More specifically, the invention relates to a planar, rolled semi-finished product made of one or more aluminum alloys, wherein the aluminum alloys have the following alloy proportions in weight-%: $2 \leqq Mg \leqq 5$; $Mn \leqq 0.5$; $Cr \leqq 0.35$; $Si \leqq 0.4$; $Fe \leqq 0.4$; $Cu \leqq 0.3$; $Zn \leqq 0.3$; $Ti \leqq 0.15$ and others at a sum of a maximum of 0.15, individually at a maximum of 0.05, residual Al, wherein the semi-finished product has been rolled off of an ingot, and during the rolling process has been subjected to at least one intermediate soft annealing between two cold roll passes and one final soft annealing, each in a batch furnace, as well as a method for the production of such a planar, rolled semi-finished product. These planar, rolled semi-finished products are aluminum strips or sheets for the further processing by means of deforming or deep drawing, for example for the production of sheet metal for car bodies for the automobile industry.

BACKGROUND

It is known that standard alloys, such as AA5052, AA5754, or AA5182, which have alloy proportions as specified above, have a tendency to form stretcher strains, particularly flow lines, during deep drawing.

Such stretcher strains are highly undesirable for high demands of the surface of exterior car body parts, as they are still visible after painting.

Moreover, various approaches are known from prior art, which result in the reduction or the complete avoidance of the undesired flow lines after deforming and deep drawing, respectively. These include in particular the addition of Zn and/or Cu, the omission of the intermediate soft annealing, and/or the final soft annealing in the continuous furnace. The setting of the grain size by means of the addition of Zn and/or Cu leads to the increased risk of creating a so-called orange skin during the deforming and the deep drawing, respectively. If the intermediate soft annealing is omitted, increased demands are created of the cold roll process or of the preliminary warm roll process, since the reductions per pass are limited with cold rolling. Finally, the use of a continuous furnace involves high initial purchase costs.

Furthermore, for avoiding flow lines during the deforming or deep drawing of semi-finished products, a method for the production of semi-finished products is known from U.S. Pat. No. 4,151,013, in which an ingot made of aluminum alloys is cold rolled into a semi-finished product directly after the hot rolling, or after an intermediate soft annealing at a reduction of thickness of at least 40%, mostly 60%-80%, the semi-finished product is then subjected to a final soft annealing in a continuous furnace, and is finally stretch-formed by 0.25% to 1%. It has been shown, however, that semifinished products produced by means of the known method do not safely avoid flow lines, for example during subsequent deep drawing.

SUMMARY OF THE INVENTION

Based on the previously described prior art, the present invention is based on the task of providing a planar, rolled semi-finished product made of aluminum alloys, and a method for the production of such a planar, rolled semi-finished product, respectively, which enables the use of standard alloys without the addition of Zn and Cu or other elements, can do without any extensive production lines, and ensures improved process safety with regard to deep drawn or deformed end products being free of flow lines.

The previously derived and shown task is solved in accordance with the first teaching of the invention in that the degree of deformation before the first intermediate soft annealing is at least 50%, and before the final soft annealing not more than 30%, and that the semi-finished product has been stretch-formed by 0.1 to 0.5% after the final soft annealing.

Initially, a rough structure is created in the semifinished product by means of a high degree of deformation of at least 50% before the first intermediate annealing so that the recrystallization temperature of the aluminum alloy is reduced, and a recrystallization of the semifinished product, which is as complete as possible, occurs during the intermediate annealing. With the subsequent cold rolling at a maximum degree of deformation of 30%, only few surface defects are incorporated into the soft, recrystallized semi-finished product so that the semi-finished product having a fine-grained structure is conveyed to the final soft annealing. The combination of the previous processing steps with the final stretch-forming and the properties of the alloy surprisingly ensure that no flow lines appear during the deforming or deep drawing of the semifinished product. Furthermore, the semi-finished product according to the invention has a long shelf life of several years, during which the properties do not substantially change. In particular, it is not necessary to set a specific grain size so that the risk of the occurrence of an orange-peel skin is not present with the deforming. Therefore, a product free of flow lines may also be obtained at grain sizes of below 50 μm. Finally, no soft or solution annealing is necessary in the continuous furnace with subsequent quenching. In summary it can be concluded that the finishing process for the production of the planar, rolled semi-finished product according to the invention has great robustness.

An advantageous embodiment of the planar, rolled semi-finished product according to the invention is that the semi-finished product has been stretch-formed after the final soft annealing by 0.2 to 0.5%. The stretch-forming by at least 0.2% further increases the process safety with the production of the semi-finished product according to the invention.

The stretch-forming of the planar, rolled semi-finished product may be performed in various manners. For example, the stretch-forming in a strip stretch-forming line, but also the stretch-forming with the assistance of the alternating turning around of the strip or the sheet on a so-called leveling line, in which the strip is stretch-formed to the exterior radius at each turn and is compressed at the interior radius.

If the semi-finished product has a coating that has been applied in retrospect using the coil coating process, the deformability of the semi-finished product in the subsequent deforming or deep drawing steps can thus be improved by means of the associated heat treatment, without adversely affecting the lack of flow lines. According to a second teaching of the invention, the previously derived and shown task is solved by means of a method for the production of a planar, rolled semifinished product made of aluminum alloys, in which the semi-finished product is rolled off of an ingot containing the above stated alloy proportions, during the rolling process is subjected to at least one intermediate soft annealing between two cold roll passes and one final soft annealing, each in a batch furnace, wherein the degree of deformation before the first intermediate soft annealing is at least 50%, and before the final soft annealing is not more than 30%, and the semi-finished product is stretch-formed after the final soft annealing by 0.1 to 0.5%.

As explained above, the semi-finished product produced in accordance with the method according to the invention has a further improved process safety with regard to avoiding flow lines during the subsequent deforming or deep drawing of the semi-finished product.

There is a multitude of possibilities to develop and further embody the planar, rolled semi-finished product according to the first teaching of the invention and the method for the production of such a planar, rolled semifinished product according to the second teaching of the invention respectively. For this purpose, reference is made, to the following description in combination with the drawing.

BRIEF DESCRIPTION OF THE DRAWING

The drawing shows the only FIGURE of an embodiment of a line for the production of a planar, rolled semi-finished product made of aluminum alloys according to the first teaching of the invention and for realizing a method for the production of such a planar, rolled semi-finished product according to the second teaching of the invention, respectively.

DETAILED DESCRIPTION OF THE INVENTION

The embodiment of the line for the production of a planar, rolled semi-finished product made of aluminum alloys according to the invention, in particular of a semi-finished product for the production of sheet metal for car bodies, has a hot roll line 1 with a reversing frame 2, and an optional subsequent, multilevel hot roll frame 3. In this hot roll line 1 an ingot 4, for example made of a standard alloy, such as AA5052, AA5754, or AA5182, is rolled off and subsequently reeled into a coil 5 on a reeling station. After cooling of the coil 5, the strip is subjected on a first cold roll line 6 to one or more cold roll passes, wherein the degree of deformation is at least 50% for the reducing of the recrystallization temperature of the strip.

In the exemplary embodiment illustrated, the cold rolled, newly reeled strip is soft annealed in a batch furnace 7 in an intermediate process. During the intermediate soft annealing, the relatively rough structure of the strip recrystallizes nearly completely so that the strip is present in a soft and recrystallized state after the intermediate annealing.

Subsequently, the intermediately soft annealed strip is again subjected to cold rolling on a second cold roll line 8 at a degree of deformation of not more than 30%. With this measure, only a low amount of surface defects is created in the strip so that the strip has a fine-grained structure after the last cold roll process.

Subsequent of the last cold roll pass, the newly reeled strip is subjected to a final soft annealing in a second batch furnace 9. Subsequently, the cooled strip is stretch-formed by 0.1 to 0.5% on a so-called leveling line 10.

Instead of the leveling line 10, a strip stretch-forming line may also be used, on which the strip is stretchformed across its entire cross-section.

The invention claimed is:

1. A method for the production of a planar, rolled semi-finished product made of aluminum alloys, wherein the aluminum alloys have the following alloy proportions in weight-%:

$2 \leqq Mg \leqq 5$;
$Mn \leqq 0.5$;
$Cr \leqq 0.35$;
$Si \leqq 0.4$;
$Fe \leqq 0.4$;
$Cu \leqq 0.3$;
$Zn \leqq 0.3$;
$Ti \leqq 0.15$; and
others at a sum of a maximum of 0.15, individually at a maximum of 0.05, residual Al, wherein the semi-finished product is rolled off of an ingot, and during the rolling process is subjected to at least one intermediate soft annealing in a batch furnace between two cold roll passes and one final soft annealing in a batch furnace after the two cold roll passes, wherein the degree of deformation before the first intermediate soft annealing is at least 50%, the degree of deformation before the final soft annealing is not more than 30%, and the semi-finished product is stretch-formed by 0.1 to 0.5% after the final soft annealing.

2. The method of claim 1, wherein the method does not include soft annealing in a continuous annealing furnace between the first cold roll pass and the stretch-forming; and the method does not include quenching between the first cold roll pass and the stretch-forming.

3. A method for the production of a planar, rolled semi-finished product that resists the formation of flow lines upon subsequent deformation or deep-drawing, the method comprising:

providing a strip formed by hot rolling an ingot that comprises at least one aluminum alloy, the at least one aluminum alloy having the following weight-% alloy proportions:

$2 \leqq Mg \leqq 5$;
$Mn \leqq 0.5$;
$Cr \leqq 0.35$;
$Si \leqq 0.4$;
$Fe \leqq 0.4$;
$Cu \leqq 0.3$;
$Zn \leqq 0.3$;
$Ti \leqq 0.15$; and others at a sum of a maximum of 0.15, individually at a maximum of 0.05, residual Al;

cold rolling the strip to a degree of deformation of at least 50% in a first cold rolling step;

subjecting the strip to at least one intermediate soft anneal in a batch furnace after the first cold rolling step;

cold rolling the strip to a degree of deformation of less than 30% in a second cold rolling step after subjecting the strip to the at least one intermediate soft anneal;

subjecting the strip to a final soft annealing in a batch furnace after the second cold rolling step; and stretch-forming the strip or a sheet made of the strip by 0.1 to 0.5% after the final soft annealing to form a semi-finished product that resists formation of flow lines upon subsequent deformation or deep-drawing;

wherein the strip is not soft annealed in a continuous annealing furnace between the first cold rolling step and the stretch-forming; and the strip is not quenched between the first cold rolling step and the stretch-forming.

* * * * *